United States Patent [19]

Kritzer

[11] 4,330,913

[45] May 25, 1982

[54] METHOD OF MAKING HEAT EXCHANGERS

[76] Inventor: Richard W. Kritzer, 400 E. Randolph, Chicago, Ill. 60601

[21] Appl. No.: 198,458

[22] Filed: Oct. 20, 1980

[51] Int. Cl.[3] ..... B21D 53/02; B23P 15/26

[52] U.S. Cl. ..... 29/157.3 A; 29/157.3 B; 29/727

[58] Field of Search ..... 29/157.3 A, 157.3 B, 29/157.3 C, 727, 157.3 R; 113/118 A, 118 B

[56] References Cited

U.S. PATENT DOCUMENTS 3,776,018 12/1973 French ..... 29/157.3 A
3,781,959 1/1974 O'Connor ..... 29/157.3 B
3,791,003 2/1974 Pasternak ..... 29/157.3 A
3,886,639 6/1975 Pasternak ..... 29/157.3 A

*Primary Examiner*—Lowell A. Larson
*Assistant Examiner*—V. K. Rising
*Attorney, Agent, or Firm*—Emrich, Lee, Brown & Hill

[57] ABSTRACT

The method of making elongated heat exchangers having outwardly projecting fins disposed at various angles to the length and width of the heat exchangers wherein elongated tubular members are fed longitudinally past cutters which are reciprocated into and out of the tubular members in skiving actions and the angles of the cutters relative to the length and width of the tubular members moving therepast are changed between at least some of the reciprocations of the cutters.

10 Claims, 7 Drawing Figures

METHOD OF MAKING HEAT EXCHANGERS

BACKGROUND OF THE INVENTION

This invention relates to methods of making heat exchangers, and, more particularly, to methods of making elongated heat exchangers having outwardly projecting fins disposed at various angles to the length of the respective heat exchanger.

It is a primary object of the present invention to afford a novel method of making a heat exchanger.

Another object is to afford a novel method of making a heat exchanger wherein external fins are formed by cutting or gouging the same from wall portions of the heat exchanger.

Another object of the present invention is to afford a novel method of making a heat exchanger of the spined type and wherein the spines are formed from outwardly projecting ribs on the heat exchanger.

A further object of the present invention is to afford a novel method of making a heat exchanger of the spined type wherein the spines are formed as integral parts of larger fin members by cutting or gouging the spines from outwardly projecting ribs and cutting or gouging the remainder of the fin members from material underlying the ribs.

The making of spined heat exchangers by cutting or gouging the spines from outwardly projecting ribs on a tubular member have been heretofore known in the art, being shown, for example, in my earlier U.S. Pat. No. 3,202,212, issued Aug. 24, 1965; and in U.S. Pat. Nos. 3,866,286, issued to Stephen F. Pasternak, on Feb. 18, 1975; 3,886,639, issued to Stephen F. Pasternak, on June 3, 1975; and 3,947,941, issued to Joseph M. O'Connor, on Apr. 6, 1976.

Also, making of spined heat exchangers wherein the spines are formed as integral parts of a larger fin member by cutting or gouging the spines from outwardly projecting ribs and cutting or gouging the remainder of the fin members from material underlying the ribs has been heretofore known in the art, being shown, for example, in U.S. Pat. No. 3,692,105, issued to Joseph M. O'Connor, on Sept. 19, 1972.

It is an important object of the present invention to afford a novel method of forming finned and/or spined heat exchangers.

Another object of the present invention is to afford a novel method of making finned and/or spined elongated heat exchangers wherein, at least, various ones of the fins and/or spines are disposed at different angles to the length of the heat exchanger.

Another object of the present invention is to afford a novel method of making heat exchangers which is effective to afford, in a novel and expeditious manner, increased turbulence in air or other working fluid passing across the completed heat exchanger.

A further object of the present invention is to enable elongated heat exchangers, having fins and/or spines projecting outwardly therefrom at various angles, to be afforded in a novel and expeditious manner.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and changes may be made as desired by those skilled in the art without departing from the present invention and the purview of the appended claims.

DESCRIPTION OF THE EMBODIMENTS SHOWN HEREIN

A method of making a heat exchange element, together with apparatus and material for practicing the same are shown in FIGS. 1–6 of the drawings to illustrate the presently preferred method of making heat exchangers in accordance with the principles of the present invention.

As will be discussed in greater detail hereinafter, in the preferred practice of the present invention a heat exchanger element 1 is preferably formed from a suitable length of tubular stock, such as the tubular member 2, FIGS. 1 and 3, working from one end portion A of the tubular member 2, FIG. 1, toward the other end B thereof, and severing the heat exchanger 1 from the remainder B-C of the tubular member 2 upon completion of the forming of the desired length of heat exchanger, such as the length A-C.

Figures 1, 2, 3:
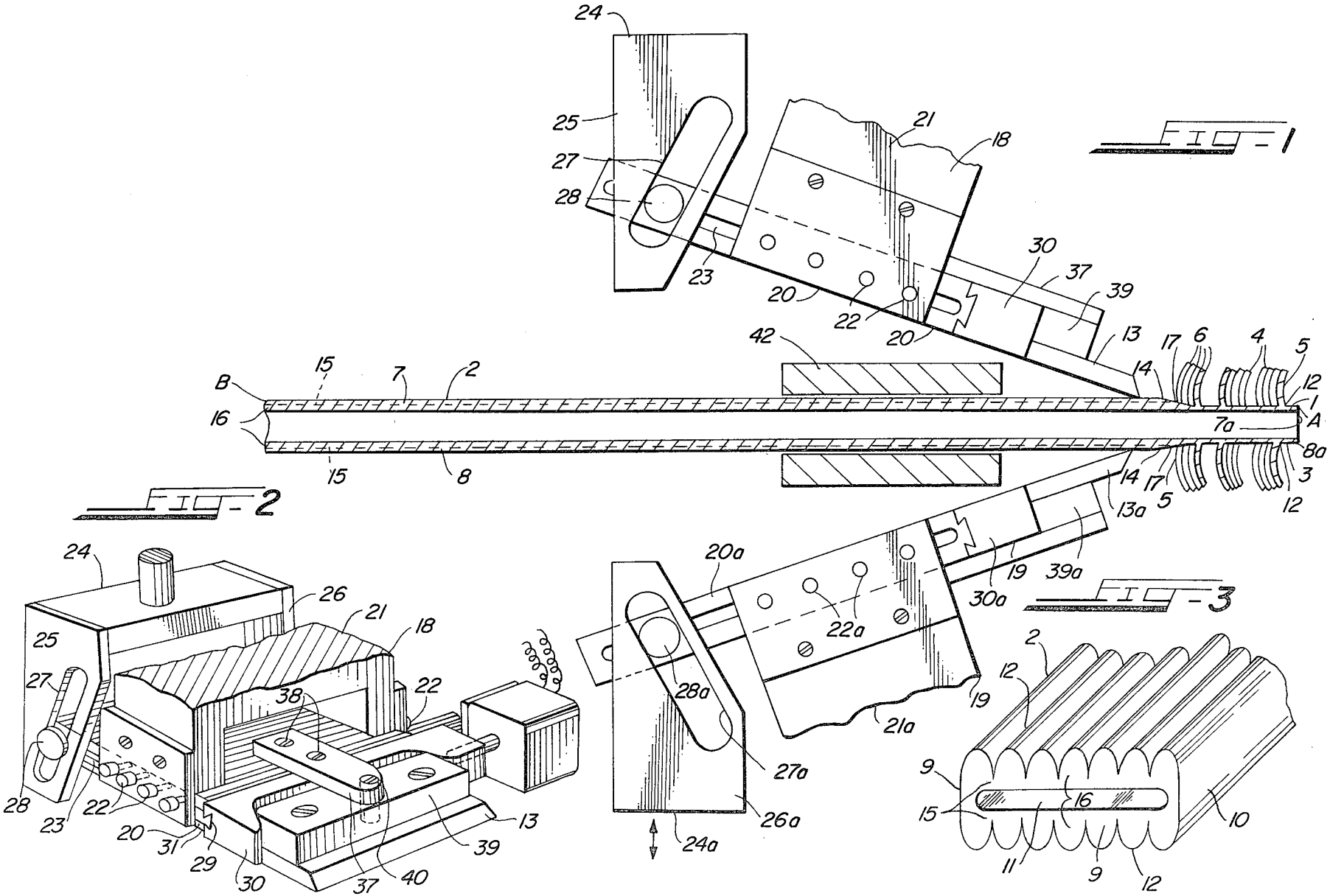
FIG. 1 is a somewhat diagrammatic showing of apparatus adapted to perform my novel method.
FIG. 2 is a fragmentary, perspective view of a portion of the apparatus shown in FIG. 1.
FIG. 3 is a fragmentary, perspective view of a portion of the preferred type of tubular member used in the practice of the method of the present invention.
Figures 4, 5, 6, 7:
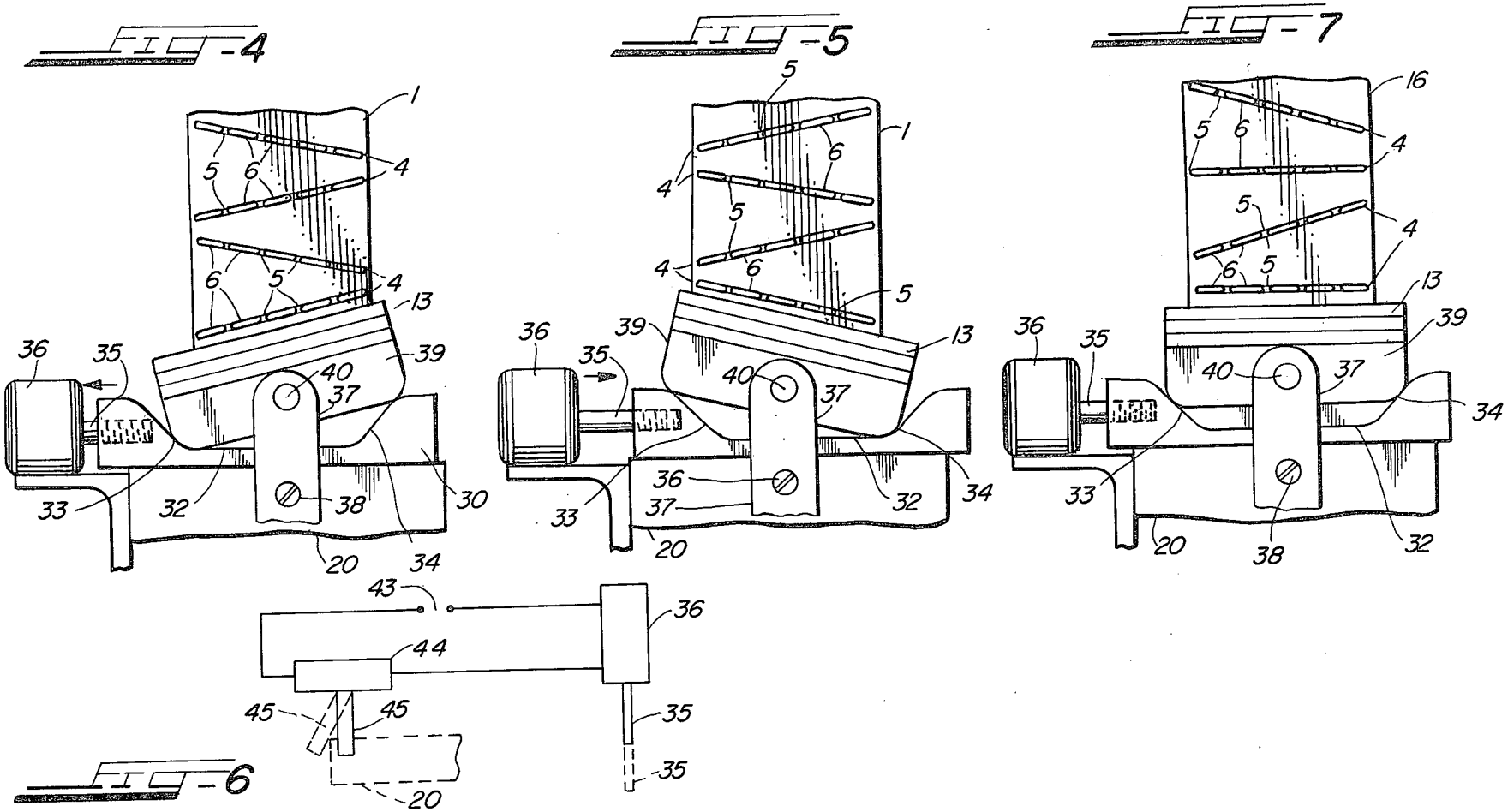
FIG. 4 is a fragmentary, top plan view of the apparatus shown in FIG. 1, showing the apparatus disposed in one position of operation.
FIG. 5 is a fragmentary, top plan view, corresponding to FIG. 4, but showing the apparatus in a different position of operation.
FIG. 6 is a wiring diagram, showing the operation of the apparatus shown in FIGS. 4 and 5.
FIG. 7 is a fragmentary top plan view, corresponding to FIGS. 4 and 5, but showing a modified operation of the apparatus.

The heat exchanger element 1, afforded by the aforementioned preferred form of the present method, embodies, in general, an elongated tubular body portion 3 having elongated fins 4 projecting outwardly therefrom, each of the fins 4 embodying an elongated base portion 5 having a plurality of spines 6 projecting outwardly from one longitudinal edge thereof, FIGS. 1, 4 and 5. Preferably, the fins are of the general type of the spined fins shown in the aforementioned O'Connor U.S. Pat. No. 3,692,105.

The tubular member 2 shown in the drawings is substantially rectangular in transverse cross-section, embodying a top wall 7 and a bottom wall 8 disposed in substantially parallel relation to each other, and two oppositely disposed side walls 9 and 10 extending between respective sides of the side walls 6 and 7 in substantially perpendicular relation thereto. An opening 11 extends longitudinally through the tubular member 2. As will be appreciated by those skilled in the art, the tubular member 2 is shown in FIGS. 1 and 3 as being rectangular in transverse cross-section and having a single opening 11 extending longitudinally therethrough merely by way of illustration and not by way of limitation, and tubular members having shapes other than rectangular and having a plurality of openings extending longitudinally therethrough may be afforded without departing from the purview of the present invention.

In the heat exchanger 1 shown in the drawings, the fins 4 project outwardly from the outer faces of two walls *7a* and *8a*, FIG. 1, corresponding to, and, in fact, formed from the walls 6 and 7 of the tubular member 2, as will be discussed in greater detail presently. The fins 4 extend longitudinally across the respective walls *7a* and *8a* in direction transverse to the length of the tubular body portion *2a*, and each of the fins 4 embodies one of the aforementioned base portions 5 having a lower longitudinal edge portion 12 integral with the respective wall *7a* or *8a* to which it is attached. Each base portion 5 projects outwardly from the respective walls *6a* and *7a*, preferably in substantially perpendicular relation thereto, with the spines 6 thereon spaced along and projecting outwardly from the longitudinal edge of the base portion 5 remote from the body portion *2a*.

The tubular member 2, from which the heat exchanger 1, shown in the drawings, is made, may be made of any suitable material, such as, for example, aluminum, and embodies a plurality of elongated outwardly projecting ribs 12, FIG. 3, on the outer face of each of the side walls 7 and 8, the ribs 12 extending longitudinally of the tubular member 2 in parallel spaced relation to each other.

In making the heat exchanger 1, a tubular member such as the tubular member 2, and embodying the ribs 12, extending the full length thereof, may first be formed. Thereafter, the fins 4 may be successively formed on each of the side walls 7 and 8 from one end portion of the tubular member 2, such as the end portion A toward the other end B thereof, FIG. 1. The fins 4 may each be cut or gouged from the walls 7 and 8 by means of suitable cutting tools, such as the cutting tools 13 and 14, FIG. 1, which first cut along lengthwise of the ribs 12 to the right, as viewed in FIG. 1, to form the surfaces 14 which terminate at their lower ends, as viewed in FIG. 1, at the base 15 of the ribs 12, the cutting tools then continuing to cut along lengthwise of the portion 16 of the wall 7 or 8 underlying the ribs 12 to form the surface 17, FIG. 1. The fins 4, which have been cut or gouged from the walls 7 and 8 of the body portion 2, are then bent outwardly preferably to a position approximately perpendicular to the planes of the walls 7 or 8 on which they are formed.

After thus forming the fins 4 along the desired length of the tubular member 2, such as the length A-C, the tubular member 2 may be severed transversely to its length at the point C to thereby afford a finished heat exchanger element having fins 4 spaced along substantially the full length thereof. As will be appreciated by those skilled in the art, if desired, the formation of the fins 4 may be commenced inwardly of the end portion A of the tubular member 2, and the tubular member may be severed outwardly to the left, as viewed in FIG. 1, of the last formed fin 4 to thereby afford end portions which project outwardly from the outermost fins 4 to afford connecting members at each end of the finished heat exchanger. In such last mentioned construction, not shown, the ribs 12 of the tubular member 2 disposed outwardly of the aforementioned outermost fins, preferably are removed by suitable means, such as, for example, grinding to thereby afford a smooth-walled end portion for the completed heat exchanger.

The method of making finned heat exchangers, thus far described herein, by cutting or gouging them from opposite sides of a tubular member, has been heretofore known in the art, being shown, for example, in the previously mentioned patents. However as is common in the art, and as is shown in each of the previously mentioned patents, the fins of such heat exchangers are disposed in parallel relation to each other along the length thereof. As a result, air, or other working fluid, passing transversely across the finned surfaces of such heat exchangers may pass across the heat exchangers in a relatively unobstructed flow, by passage in the same parallel relation to the fins. An important purpose of the present invention is to afford a novel method of making heat exchangers, wherein the fins, cut or gouged from the surfaces of a tubular member in the aforementioned manner, are so disposed that the air passing transversely across such a heat exchanger, or a substantial portion of such air, is caused to impinge against the fins in such a manner as to create turbulence in the air between the fins and thereby cause a greater heat exchange between the air and the fins that the air is passing between. In accordance with the principles of my invention, this is accomplished by forming the fins, such as the aforementioned fins 4 and 5, on the heat exchanger in such a manner that at least certain of the fins extend across the heat exchanger at different angles to the length of the heat exchanger, and, as will be discussed in greater detail presently, in the preferred form of my invention, such fins are so cut that the fins in each adjacent pair of such fins are disposed at different angles to the length of the heat exchanger, as illustrated in FIGS. 4 and 5.

In FIGS. 1–6 of the drawings, apparatus, which is suitable for the practice of the preferred form of my invention is shown to illustrate a manner in which the invention may be practiced. This apparatus includes the two aforementioned cutter bars 13 and 14, each of which is operatively connected to suitable mechanism 18 and 19, for forming the fins 4 in accordance with the principles of the present invention, as will be discussed in greater detail hereinafter.

The mechanisms 18 and 19 are identical in construction, except that they are mirror images of each other and, therefore, parts of the mechanism 19, which are identical to corresponding parts of the mechanism 18 are indicated in the drawings by the same reference numerals as the corresponding parts of the mechanism 18, but with the suffix "a" added thereto.

The mechanism 18, FIGS. 1 and 2, embodies an elongated, substantially rectangular-shaped cutter slide 20 slideably mounted in the bottom portion of a substantially inverted U-shaped, stationarily mounted cutter guide 21, for longitudinal reciprocation therethrough. The cutter guide 21 has a plurality of pins 22 mounted in the opposite side walls thereof and projecting into elongated grooves 23 formed in the respective opposite sides of the cutter slide 20, and extending the length thereof, for mounting the slide 20 in the cutter guide 21 for the aforementioned longitudinal reciprocation therethrough.

The mechanism 18 also includes a substantially inverted U-shaped cross-head 24 movably mounted therein for vertical reciprocation relative to the cutter slide 20. The cross-head 24 embodies two vertically extending side walls 25 and 26 disposed on opposite sides of the slide 20, the side walls 25 each having cam slots 27 disposed therein, only the cam slot 27 in the side wall 25 being shown in the drawings. Pins 28, one of which is shown in the drawings, are mounted in the opposite sides of the slide 20 and project outwardly through respective ones of the cam slots 27 in such position that vertical reciprocation of the cross-head 24 is effective to reciprocate slide 20 longitudinally through the guide 21 by reason of the engagement of the pins 28 with the side walls of the cam slots 27.

The cutter slide 20 has a dove-tailed rib 29 extending across the front end thereof, and a cam 30, having a groove 31, which is complimentary to the rib 29, on the rear face thereof is mounted on the front end of the cutter slide 20, with the rib 29 disposed in the groove 31, for reciprocation of the cam 30 back and forth across the front end of the cutter slide 21 for a purpose which will be discussed in greater detail presently.

The front side of the cam 30 is of a modified U-shape, having an elongated central portion 32, disposed in substantially parallel relation to the slot 31, and two end portions 33 and 34 sloping forwardly from respective ends of the central portion 32 at oppositely opening obtuse angles thereto, FIGS. 4 and 5. The core 35 of a solenoid 36 is operatively connected to the cam 30 for reciprocating the latter back and forth across the front end of the cutter slide 20, between the position shown in FIG. 4 and the position shown in FIG. 5, for a purpose which will be discussed in greater detail hereinafter.

An elongated strap 37 is secured to the front end portion of the slide 20 by suitable means such as screws or bolts 38 and projects forwardly from the slide 20 across the top of the cam 30, FIGS. 2, 4 and 5. A substantially rectangular-shaped mounting member 39, which is of such length that the rear side thereof will fit between the end portions 33 and 34 of the cam 30 when the rear side of the mounting member 39 is disposed in parallel relation to the slot 31, is rotatably mounted on the front end portion of the strap 37 by suitable means such as a pin or bolt 40, in such position that, when the cam 30 is disposed in mid-position between the positions shown in FIGS. 4 and 5, the rear side of the mounting member 39 is disposed in the aforementioned parallel relation to the slot 31 with the rear corners of the mounting member 39 disposed in engagement with substantially the mid-portion of the respective end portions 33 and 34 of the front side of the cam 30.

The cutter is mounted on the lower face of the mounting member 39 and is secured thereto by suitable means such as screws or bolts 41, the front cutting edge of the cutter 13 projecting forwardly from the mounting member 39 and being disposed in parallel relation to the length of the mounting member 39.

From the foregoing it will be seen that vertical reciprocation of the cross-head 24 is effective through the engagement of the pins 28 with the side walls of the cam slots 27 to reciprocate the cutter slide 20 longitudinally through the cutter guide 21, and thus correspondingly reciprocate the cam 30, the solenoid 36, the mounting member 39 and the cutter 13, which are mounted thereon. This, it will be seen, is effective to reciprocate the cutter 13 through the cutting or gouging motions, heretofore mentioned, for forming fins, such as the fins 4.

The apparatus, of which the mechanism 18 forms a part, also includes a guide 42 for a tubular member, such as the tubular member 2, for longitudinal movement of the tubular member 2 therethrough. The guide 42 is disposed in position to effectively support the tubular member 2 in position for the aforementioned cutting or gouging operations of the cutter 13 on tubular member 2.

The aforementioned apparatus also includes a power source 43 connected through a suitable switch, such as a sequencing switch 44 to the solenoid 36, FIG. 6. The sequencing switch 44 includes a control member 45, which is disposed in position to be engaged by the cutter slide 20 during each reciprocation of the latter, to thereby move the control member 45 from its normal position shown in solid lines in FIG. 6 to its actuated position shown in broken lines in FIG. 6 during each reciprocation of the slide 20. In the preferred form of the present invention, illustrated in FIGS. 1–6, each such actuation of the switch 44 is effective to cause the core 35 of the solenoid 36 to move between the fully retracted position shown in FIG. 4 and the fully extended position shown in FIG. 5. This, it will be seen, is effective to cause the mounting member 39 to be rocked between the position shown in FIG. 4 and the position shown in FIG. 5, on alternate reciprocations of the slide 20, by reason of the engagement of the mounting member 39 with the end portions 34 and 33, respectively, of the cam 30. Such rocking of the mounting member 39 is effective to correspondingly rock the cutter 13, so that, during each successive reciprocation of the cutter slide 20, the cutter 13 is turned to an oppositely opening acute angle to the width of the tubular member 2, as shown in FIGS. 4 and 5. Thus, in the preferred form of the present invention, each successive reciprocation of the cutter 13 is effective to cause a fin 4 to be formed on the tubular member 2 at a correspondingly different acute angle to that of the immediately succeeding and preceding fins 4, as illustrated in FIGS. 4 and 5.

The operation of the mechanism 19 is the same as that of the mechanism 18, except that the mechanism 19 is disposed below the tubular member 2, and operates on the lower face thereof.

Although, as previously mentioned, in the preferred practice of the present invention, adjacent ones of the fins, such as the fins 4, are formed on the heat exchanger 1 at oppositely opening acute angles to the width of the heat exchanger 1, this is merely by way of illustration of the preferred practice of the present invention, and is not by way of limitation thereto, and all adjacent fins need not be disposed at various angles to each other to be within the purview of the broader aspects of the present invention, it being sufficient that certain of the fins along a length of a heat exchanger are disposed at different angles.

Also, within the broader purview of the present invention, even when all adjacent fins are disposed at different angles to the width of the heat exchanger, they need not be disposed at oppositely opening acute angles, but may be disposed at other angles, such as, for example, with alternate ones of the fins 4 being disposed at the aforementioned oppositely opening acute angles, and with the fins 4 between each pair of the aforementioned alternate fins 4 being disposed perpendicular to the length of the heat exchanger, such as shown with respect to the heat exchanger $1_b$ shown in FIG. 7.

This may be readily accomplished by using a sequencing switch 44 which is effective to stop the cam 30 at an intermediate position, as shown in FIG. 7, between each movement of the core 35 of the solenoid 36 between the extreme inward and outward positions thereof, shown in FIGS. 4 and 5, respectively. Sequencing switches effective to accomplish this are well known in the art.

From the foregoing it will be seen that the present invention affords a novel method of making heat exchangers.

In addition, it will be seen that the present invention affords a novel method of making a heat exchanger having improved heat-transfer characteristics between the fins thereof and the working fluid passing therebetween.

In addition, it will be seen that the present invention affords a novel method of making heat exchangers which is practical and efficient in operation and which may be readily and economically accomplished.

Thus, while I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. The method of forming fins on a heat exchange element, which comprises the steps of
(a) feeding an elongated tubular body member longitudinally past a cutter,
(b) reciprocating said cutter forwardly and rearwardly toward and away from the outer surface of said body member at an acute angle thereto and cutting into said surface during the forward movement of said cutter in a skiving action, thereby to form an upstanding fin, one edge of which is integral with said body member, and
(c) changing the angle of the cutter in a direction transverse to the length of said body member and to the direction of said reciprocation prior to at least some of the forward movements of said cutter, thereby
(d) to provide fins positioned at various angles with respect to said body member in a direction transverse to the length and width of said surface.

2. The method defined in claim 1, and in which
(a) said angle of said cutter transverse to the length of said body member is changed prior to each forward movement of said cutter, thereby
(b) to position all adjacent ones of said fins at different ones of said various angles.

3. The method defined in claim 2, and in which
(a) adjacent ones of said changed angles of said cutter are on opposite sides of the perpendicular to said length of said body member.

4. The method defined in claim 2, and in which
(a) said angle of said cutter at alternate changes thereof is perpendicular to the length of said body member.

5. The method defined in claim 4, and in which
(a) adjacent ones of said changed angles of said cutter on opposite sides of said alternate changes are acute angles opening on opposite sides of said angle of a respective one of said alternate changes.

6. The method of forming fins on a heat exchange element, which comprises the steps of
(a) feeding an elongated tubular body member, having a substantially rectangular-shaped outer surface, longitudinally past a cutter, having an elongated cutting edge,
(b) reciprocating said cutter forwardly and rearwardly toward and away from said surface at an acute angle thereto and cutting into said body member during each forward movement of said cutter in a skiving action, thereby to form adjacent upstanding fins, having elongated edge portions integral with said body member and extending transversely across said surface, and
(c) changing the angle of said cutting edge in a direction transverse to the length of said body member and to the transverse width of said surface prior to at least some of the forward movements of said cutter, thereby
(d) to provide fins, said edge portions of which are disposed at various angles with respect to said body member in a direction transverse to the length of said body member and to the transverse width of said surface.

7. The method defined in claim 6, and in which
(a) said angle of said cutting edge is changed prior to each forward movement of said cutter, thereby
(b) to dispose adjacent ones of said edge portions, longitudinally of said body member, at different ones of said various angles.

8. The method defined in claim 6, and in which
(a) certain ones of said various angles open outwardly away from one side of the perpendicular to said length of said body member, and
(b) other ones of said various angles open outwardly away from the side opposite to said one side of said perpendicular.

9. The method defined in claim 6, and in which
(a) said outer surface comprises a plurality of elongated, substantially parallel, spaced ribs extending longitudinally of said body member.

10. The method defined in claim 9, and in which
(a) said forward movement of said cutter bar is inwardly through said ribs into the portion of said body member underlying said ribs, whereby
(b) each of said fins comprises
(1) one of said underlying edge portions, and
(2) a plurality of protuberances projecting outwardly from said underlying edge portion.

* * * * *